US009243434B2

(12) United States Patent
Koarai et al.

(10) Patent No.: US 9,243,434 B2
(45) Date of Patent: Jan. 26, 2016

(54) FRICTION HINGE FOR A CONSOLE BOX LID

(75) Inventors: Manabu Koarai, Tokyo (JP); Takuya Uehara, Tokyo (JP)

(73) Assignee: Moriroku Technology Company, Ltd., Tokyo (JP)

( * ) Notice: Subject to any disclaimer, the term of this patent is extended or adjusted under 35 U.S.C. 154(b) by 71 days.

(21) Appl. No.: 13/186,997

(22) Filed: Jul. 20, 2011

(65) Prior Publication Data

US 2012/0102677 A1 May 3, 2012

(30) Foreign Application Priority Data

Jul. 20, 2010 (JP) ..... 2010-162489

(51) Int. Cl.
*E05D 11/08* (2006.01)

(52) U.S. Cl.
CPC ..... *E05D 11/087* (2013.01); *Y10T 16/5403* (2015.01)

(58) Field of Classification Search
CPC .... E05D 11/08; E05D 11/087; Y10T 16/5403
USPC ..... 16/337
See application file for complete search history.

(56) References Cited

U.S. PATENT DOCUMENTS 5,772,351 A * 6/1998 Ching ..... 403/111
5,937,482 A * 8/1999 Horng ..... 16/340
6,125,507 A * 10/2000 Katoh ..... 16/329
6,453,509 B1 * 9/2002 Shin ..... 16/340
6,481,057 B2 * 11/2002 Lin ..... 16/340
6,618,903 B2 * 9/2003 Kim ..... 16/337
6,665,907 B1 * 12/2003 Lu ..... 16/340
6,671,928 B2 * 1/2004 Huang ..... 16/340
7,784,154 B2 * 8/2010 Chen ..... 16/342
7,823,254 B2 * 11/2010 Lin ..... 16/337
7,845,051 B2 * 12/2010 Saito et al. ..... 16/337
2005/0166365 A1 * 8/2005 Hsieh ..... 16/337
2008/0184529 A1 * 8/2008 Thom ..... 16/337
2009/0144936 A1 * 6/2009 Chern ..... 16/337
2009/0151122 A1 * 6/2009 Chuan ..... 16/340

FOREIGN PATENT DOCUMENTS

JP 08319753 12/1996
JP 2007091002 A 4/2007
JP 2009255786 11/2009

* cited by examiner

*Primary Examiner* — Jeffrey O Brien
(74) *Attorney, Agent, or Firm* — Head, Johnson & Kachigian, P.C.

(57) ABSTRACT

The hinge structure of a console box including a brake shaft and a braking device, arranged in a place displaced in the axial direction of a hinge shaft and disposed on one side of the hinge shaft. When opening and closing a lid, the drive shaft and the hinge shaft rotate in conjunction with the rotation of the lid, while a friction plate between the brake shaft and a braking plate is pressed against the rotating end face and the stationary brake plate, which is secured to a storage box, and a predetermined friction force can be produced continuously. Due to the friction force, the lid can be rotated under the influence of a moderate extent of rotational resistance when opening and closing the lid, and the position of the lid can be kept in the place where the lid stopped rotating within a rotatable range of the lid.

10 Claims, 8 Drawing Sheets

FRICTION HINGE FOR A CONSOLE BOX LID

FIELD OF THE INVENTION

The present invention relates to a hinge structure for a lid of a console box that may be installed in a center console or other spaces of a vehicle and more specifically, a hinge structure of a console box lid for a vehicle, wherein the position of the lid can be kept in the place where the lid stopped rotating within the rotatable range of the lid.

DESCRIPTION OF THE RELATED ART

A storage container for a vehicle is generally used for storing driver's personal belongings, wherein the storage container comprises a container body having an opening for putting personal items in and taking the items out of the container body, and the container body being attached to a center console installed between a driver's seat and a front passenger's seat of a vehicle. Many of the storage containers for a vehicle have a slide lid or a rotating lid for closing the opening of the container body when the storage container is not used. The rotating lid is supported by a hinge shaft to rotate between a closed position and an open position of the lid.

A lid-holding device for keeping the position of the lid in the place where the lid stopped rotating has been proposed to stop the lid at any position within the rotating range of the lid. JP 2009-255786 A discloses, for example, a device for holding a lid in the intermediate open position, which prevents cost increase caused by the increase in the number of components and assembling steps and eliminates the necessities of torque-control or the like during assembling. The device comprises an anchoring side bracket secured to a container body, a movable side bracket secured to a lid, and a hinge assembly connecting the anchoring side bracket and the movable side bracket rotatably. A male screw is formed on the outer periphery of a hinge shaft and the male screw is screwed in the anchoring and/or movable side brackets to form a screw mechanism so as to prevent loosening between the hinge part and the anchoring and/or movable side brackets. The screw mechanism provides the anchoring side bracket and the movable side bracket with mechanical resistance torque so that the lid can be rotated to a desired position by the torque more than the resistance torque and the position of the lid can be held by the resistance torque.

In the above-mentioned device for holding a lid in the intermediate open position, the anchoring side bracket and the movable side bracket are made by a member separated from the container body and the lid, respectively and are secured to the container body and the lid by means of screws or the like, respectively. Therefore, the number of steps for assembling the device between the body of the storage box and the lid would necessarily increase. In order to provide adequate bond strength for fixing the both side brackets to the container body and the lid, there should be sufficient quantities of the areas where the both side brackets are in contact with the container body and the lid. Since the contact areas are formed by a planar surface that extends on the surfaces of the container body and the lid, the planar surface is an obstacle to changing the contours of the storage box and the lid. Furthermore, it might be necessary to form a reinforcement structure such as ribs or the like on the container body and the lid, in order to enhance rigidity of the contact areas. If the rigidity of the contact areas is insufficient, the device cannot be attached firmly. Such a reinforcement structure as mentioned above makes the vicinity of the contact areas larger in size, and the capacity of the storage container may decrease and the size of the lid may become larger. When a storage container is installed in a limited space, the large container body and the large lid may restrict the capabilities of the storage container and the flexibility of the design.

SUMMARY OF THE INVENTION

The present invention provides a hinge structure of a console box lid, wherein the position of the lid can be held in the place, where the lid stopped rotating around a hinge shaft, within the rotatable range of the lid. The present invention also provides a hinge structure of a lid of a console box, which is compact in size and can easily be installed.

Therefore, the primary object of the present invention is to provide a hinge structure of a console box lid, wherein the position of the lid can be held in the place, where the lid stopped rotating around the hinge shaft, within the rotatable range of the lid.

The other object of the present invention is to provide a hinge structure of a console box lid, which can easily be installed in a limited space by a limited number of fabrication processes.

Another object of the present invention is to provide a hinge structure of a console box lid, wherein the lid can smoothly open and close, due to the hinge structure that the hinge shaft is not jounced in the shaft bearing even if a bending force and/or a twisting force are applied on the lid when opening or closing the lid.

Another object of the present invention is to provide a hinge structure of a console box lid, which is suitable for a hinge structure of a lid of a vehicle console.

The hinge structure of a console box according to the present invention comprises: a storage box having an opening for putting goods in the storage box and taking goods out of the storage box; a lid adapted to close at least a part of the opening; a hinge shaft rotatably connecting the lid to the storage box so that the lid can open and close at least a part of the opening; and a lid-holding device for keeping the position of the lid in the place, where the lid stops rotating around the hinge shaft, within the rotatable range of the lid, characterized in that one or more bearing portions are formed on said storage box and said lid;

said hinge shaft is rotatably supported by said bearing portions;

said lid-holding device comprises:

said rotational axis is coaxial with said hinge shaft and said end face extends to intersect with said rotational axis;

a connecting member coupling said brake shaft to said lid;

means for preventing said brake shaft and said connecting member from relatively revolving around said rotational axis; and a braking device having a brake plate, which is secured to said storage box and adapted to cooperate with said end face of said brake shaft to generate frictional force, and said braking device being adapted to provide said brake shaft with resistance force against revolution in order to keep the position of said lid in the place mentioned above, and said brake shaft and said braking device are arranged in the axial direction of said hinge shaft.

The hinge structure of a console box lid according to the present invention is further characterized in that the brake plate is disposed to be alongside the end face of the brake shaft and intersect with the rotational axis of the brake shaft. The brake device further comprises a friction plate, which is arranged between the brake plate and the end face and pressed against the brake plate and the end face. The brake plate is fixed in relation to the storage box when the brake shaft is coupled to the lid by the connecting member, or the brake plate is fixed in relation to the lid when the brake shaft is coupled to the storage box by the connecting member.

The hinge structure of a console box lid according to the present invention is further characterized in that the end face is formed on one end of the brake shaft; the hinge shaft is formed on the other end of the brake shaft; a retaining part that extends to intersect with the rotational axis and a locking part that prevents the brake shaft from revolving with respect to the connecting member are formed on a periphery of the brake shaft; the connecting member is arranged outside the bearing portions and disposed in the axial direction of the hinge shaft; a through-hole extending in the axial direction of the hinge shaft is formed on the connecting member; the brake shaft is inserted in the through-hole; the retaining part is arranged to abut on a side surface of the connecting member and the locking part is arranged to engage the through-hole; an E-shape snap ring is attached to the end of the hinge shaft that projects from the bearing portions; and the connecting member and the bearing portions are wedged in between the E-shape snap ring and the retaining part.

The hinge structure of a console box lid according to the present invention is further characterized in that a support shaft is formed in the end face of the brake shaft so that the support shaft projects along the rotational axis of the brake shaft; the friction plate and the brake plate are arranged to engage the support shaft rotatably; one or more spring plates and washers are further arranged to engage the support shaft; a swaged portion is formed on the end of the support shaft; and the spring plates and washers are wedged between the swaged portion and the brake plate so that the friction plate is pressed against the end face of the brake shaft and the brake plate with a predetermined pressure.

The hinge structure of a console box lid according to the present invention includes the bearing portions that are formed on the storage box and the lid and are adapted to rotatably support the hinge shaft by the bearing portions. In order to connect the storage box and the lid by the hinge shaft, the bearing portion of the storage box is aligned with the bearing portion of the lid and then, the hinge shaft is inserted into the bearing portions. The hinge shaft can be retained by the E-shape snap ring or the like. Thereby, the hinge structure can facilitate the coupling of the storage box and the lid and can reduce the number of steps for coupling the storage box and the lid.

The hinge structure of a console box lid according to the present invention includes the lid-holding device. The lid-holding device can keep the position of the lid in the place where the lid stopped rotating around the hinge shaft. Thereby, a user of the storage box can take personal articles in and out of the storage box without holding the lid by hand after he rotated the lid to a desired position by hand.

The lid-holding device comprises: a brake shaft having a rotational axis, which is coaxial with a longitudinal axis of the hinge shaft, and an end face arranged to intersect with the rotational axis of the brake shaft; a connecting member coupling the brake shaft to the lid or the storage box; means for preventing the brake shaft and the connecting member from relatively revolving around the rotational axis of the brake shaft; and a braking device having a brake plate that cooperates with the end face of the brake shaft and generates frictional force, wherein the frictional force provides the brake shaft with the resisting force against the revolution thereof that can keep the position of the lid in the place where the lid stopped rotating within a rotatable range of the lid. Since the brake shaft is arranged in the axial direction of the hinge shaft and the braking device may be disposed along the end face of the brake shaft, the brake shaft and the braking device can be displaced to one side in the axial direction of the hinge shaft. In other words, the hinge structure of the present invention does not occupy a large space for installation especially in the radial direction of the hinge shaft. Therefore, the hinge structure can be applied to the console box that is installed in a limited space, without reducing the capacity of the storage box.

The aforementioned braking device has a brake plate that extends to intersect with the rotational axis of the brake shaft. The braking device may further include a friction plate that is arranged between the brake plate and the end face of the brake shaft, so that the friction plate is pressed against the brake plate and the end face of the brake shaft. Since those brake plate and brake shaft each may be composed of thin plate members arranged parallel to the end face of the brake shaft, they do not occupy a large space for installation. In addition, the brake plate may be fixed in relation to the storage box when the brake shaft is coupled to the lid, while the brake plate may be fixed in relation to the lid when the brake shaft is coupled to the storage box. When opening and closing the lid, the brake plate does not rotate while the brake shaft rotates, and the brake shaft does not rotate while the brake plate rotates. Therefore, due to the braking device, a friction force can effectively be generated between the stationary member and the rotating member. As a result, the braking device can securely keep the position of the lid in the place where the lid stopped rotating around the hinge shaft. When the friction member is arranged between the end face of the brake shaft and the brake plate, the braking device can also generate a stable friction force because the friction plate is pressed between a stationary member and a rotating member. Since a friction surface is formed on the both sides of the friction plate by inserting the friction plate, the area of the friction surface may be doubled and therefore, the hinge structure can be reduced in size. Furthermore, the friction force for holding the lid can easily be adjusted to a desired measure, because the contact area among the friction plate and the brake shaft and the brake plate can be varied by changing the size of the friction plate.

The mounting and positioning of the hinge shaft and the brake shaft can be carried out simultaneously, if the end face of the brake shaft is formed at one end of the brake shaft; the hinge shaft being formed at the other end of the brake shaft; the periphery of the brake shaft being provided with a retaining part, which extends to intersect with the rotational axis of the brake shaft and prevent disengagement of the brake shaft, and a locking part, which prevents the brake shaft and the connecting member from relatively revolving around the rotational axis of the brake shaft; the connecting member being arranged on the outside of the bearing portions and disposed along the longitudinal axis of the hinge member; the connecting member being formed with a through-hole extending in the axial direction of the hinge shaft; the brake shaft being inserted into the through-hole; the retaining part being arranged to abut on the side surface of the connecting member; and the locking part is arranged to engage the through-hole. In addition, if an E-shape snap ring is attached to the end of the hinge shaft that projects from the bearing portions, and the connecting member and the bearing portions are wedged between the E-shape snap ring and the retaining part, the lid can smoothly open and close even though a bending force and/or a twisting force are applied on the lid when opening and closing the lid.

The friction plate, the brake plate, the spring plate and the washer may be attached to the brake shaft in advance, if a support shaft is formed on the end face of the brake shaft so as to project along the rotational axis of the brake shaft, and the friction plate, the brake plate, the spring plate and the washer are arranged to rotatably engage the support shaft, and the end of the support shaft is processed to form a swaged portion. When forming the swaged portion, the washer may be wedged between the spring plate and the swaged portion and thereby, the washer may apply the swaging force to the spring plate evenly. Thereby, the friction plate can abut on the end face of the brake shaft and the brake plate with a predetermined pressure due to the spring force generated by the spring plate. Furthermore, mounting the lid-supporting structure can be accomplished by the step of securing the brake plate to the lid or the storage box by tapping or the like and therefore, the number of the steps for attaching the hinge structure can be reduced.

In the constituent parts of the hinge structure, the braking device, the brake shaft and the hinge shaft may be assembled in advance to form a hinge-shaft assembly. Since the braking device, the brake shaft and the hinge shaft of the assembly are arranged on the rotational axis of the hinge shaft, the lid-holding device may be mounted simultaneously with rotatably connecting the lid and the storage box, by inserting the hinge shaft, in one direction, into the bearing portions of the lid and the storage box, and into the connecting member that is preliminarily formed on the lid or the storage box. After the hinge-shaft assembly is mounted on the lid or the storage box, the brake shaft may also be connected to the lid or the storage box by connecting members that are fabricated separately from the lid and the storage box.

In the constituent parts of the hinge structure, the braking device and the brake shaft may preliminarily be assembled to form a brake assembly. When preparing the brake assembly, the hinge shaft can be made as a separate part independently from the brake assembly and inserted into the bearing portions of the lid and the storage box. The hinge shaft may be inserted in the same direction as the brake shaft of the brake assembly is inserted, or in the opposite direction thereof. Regardless of the directions that the brake shaft is inserted, the rotational axis of the brake shaft should be arranged to be coaxial with the longitudinal axis of the hinge shaft. In case that the brake assembly is assembled in advance, the lid and the storage box may be rotatably coupled by another hinge joint, instead of inserting the hinge shaft into the bearing portions of the lid and the storage box. The brake assembly attached to a console box can provide only an operation of holding the lid at any position where the lid stops rotating around the hinge shaft.

Other features of the present invention will become apparent from the following descriptions of the embodiments that are given with reference to the drawings.

DETAILED DESCRIPTION OF THE PREFERRED EMBODIMENTS

Figure 1:
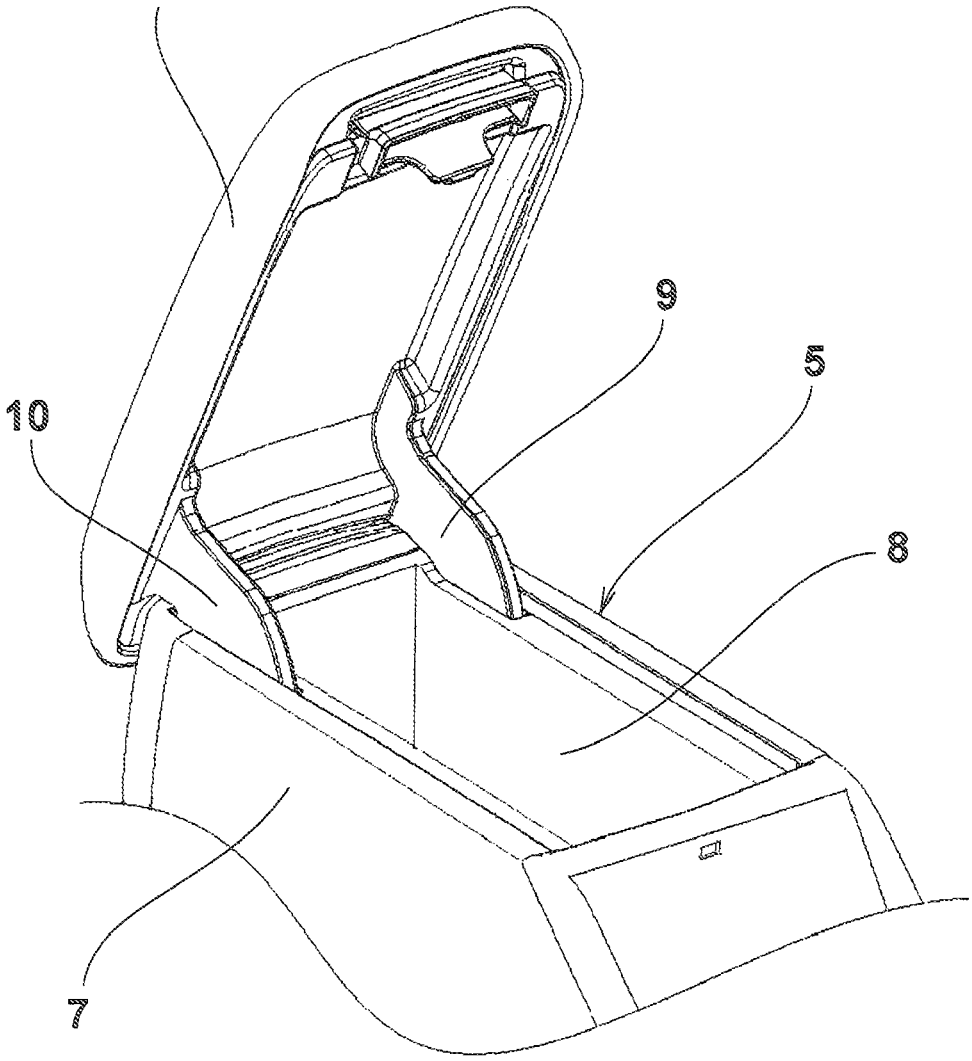
FIG. 1 shows a perspective front view of a console box of a vehicle, in which a hinge structure according to the present invention is mounted.

The hinge structure of a console box of a vehicle comprises a brake shaft and a braking device, which are arranged in one side displaced along the longitudinal axis of the hinge shaft so that the hinge structure can be easily installed in a limited space with reduced number of steps for installation. In addition, the hinge structure can smoothly open and close the lid even if a bending force and/or a twisting force are applied on the lid when opening or closing the lid.

First Embodiment

FIGS. 1-6 illustrate the first example of the hinge structure according to the present invention. The features of this hinge structure reside in that a lid 6 and a storage box 7 of a console box 5 for a vehicle are connected through a hinge-shaft assembly 4 that had been produced beforehand by fitting a hinge shaft 1 and a brake shaft 2 and a braking device 3 together. The hinge shaft 1 connects the lid 6 to the storage box 7 rotatably so that the open and close the opening 8 of the storage box 7. The hinge shaft 1 may be fabricated from the steel products equivalent to SUM24L. The hinge shaft 1 has a circular section that is perpendicular to a central axis 1*a* of the hinge shaft 1. As illustrated in FIG. 6A, the hinge shaft 1 is generally cylindrical in shape and an annular groove 1*c* that extends along the peripheral surface of the hinge shaft 1 is formed in the vicinity of one end 1*b* of the hinge shaft 1. Between the end 1*b* of the hinge shaft 1 and the annular groove 1*c*, the hinge shaft 1 has a cone-shaped part that becomes smaller in diameter in the direction of the one end 1*b* of the hinge shaft 1 in order to facilitate the insertion of the hinge shaft 1 when the hinge-shaft assembly 4 is mounted.

Figure 4:
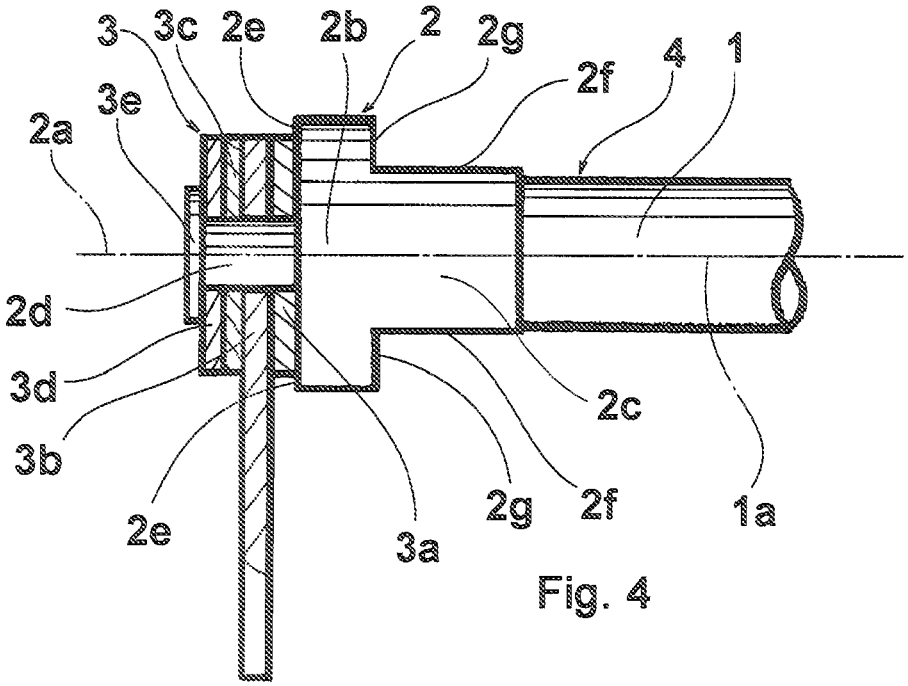
FIG. 4 shows an enlarged sectional view of the part indicated by reference numeral X in FIG. 3.
Figure 5:
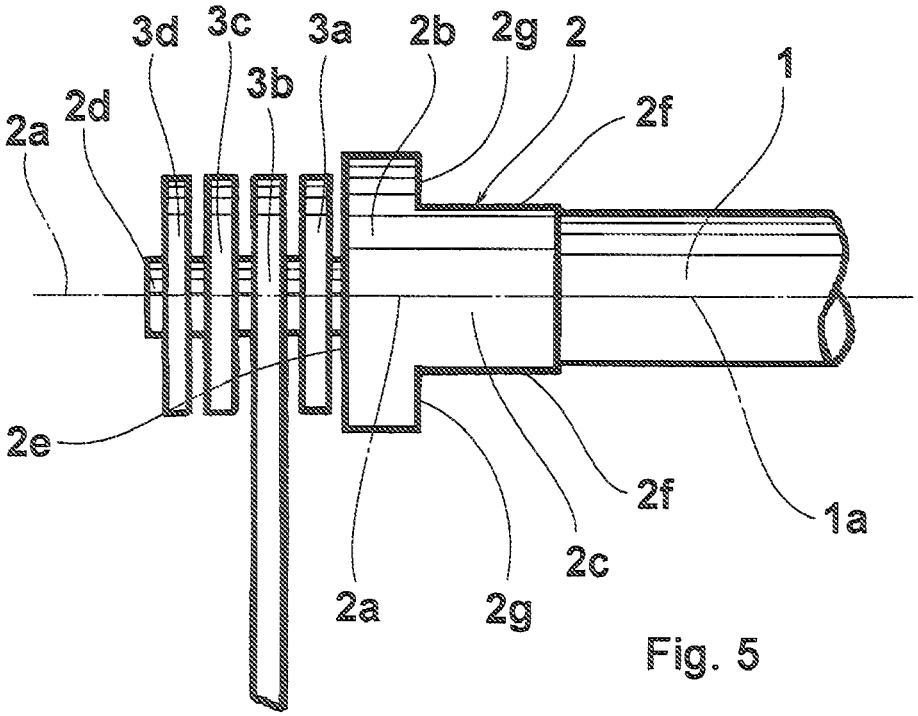
FIG. 5 shows a side view of the parts of a braking device, in which the parts are engaging a support shaft, while the end of the support shaft has not been swaged yet.

The brake shaft 2 is formed at the other end of the hinge shaft 1, that is, at the opposite end of the one end 1*b*, and integrated with the hinge shaft 1. The brake shaft 2 may be fabricated from the steel products equivalent to SUM23L. As illustrated in FIGS. 4 and 5, the rotational axis 2*a* of the brake shaft 2 is coaxial with the longitudinal or central axis 1*a* and the rotational axis 2*a* coincides with the central axis 1*a*. In this application, the rotational axis 2*a* defines an axis that forms a central axis of rotation of the brake shaft 2 when the brake shaft 2 rotates. The brake shaft 2 is composed of a cylindrical column 2*b* having a central axis that coincides with the rotational axis 2*a*, a flattened portion 2*c* having a central axis that coincides with the rotational axis 2*a*, and a support shaft 2*d* of a cylindrical shape having a central axis that coincides with the rotational axis 2*a*. The cylindrical column 2*b* has an end face 2*e* extending in the direction perpendicular to the rotational axis 2*a* and the end face 2*e* defines a circular friction surface. The flattened portion 2*c* extends between the cylindrical column 2*b* and the hinge shaft 1 and the flattened portion 2*c* is integrated with the cylindrical column 2*b* and the hinge shaft 1. A pair of flat surfaces 2*f*, 2*f* are formed on the periphery of the flattened portion 2*c* and arranged at the corresponding positions with respect to one another. The flat surfaces 2*f*, 2*f* each run parallel to the rotational axis 2*a* and form a locking part that prevents the brake shaft 2 from revolving around the rotational axis 2*a* of the brake shaft 2. A pair of engaging surfaces 2*g*, 2*g* are formed between a pair of flat surfaces 2*f*, 2*f* and the cylindrical column 2*b*, so that the engaging surfaces 2*g*, 2*g* extend in a direction perpendicular to the rotational axis 2*a*. The engaging surfaces 2*g*, 2*g* run parallel to the end face 2*e* of the cylindrical column 2*b* and which form the retaining part for preventing disengagement of the brake shaft 2. The support shaft 2*d* is formed at the center of the end face 2*e*, so that the support shaft 2*d* projects from the end face 2*e* along the rotational axis 2*a*.

Figure 6A:
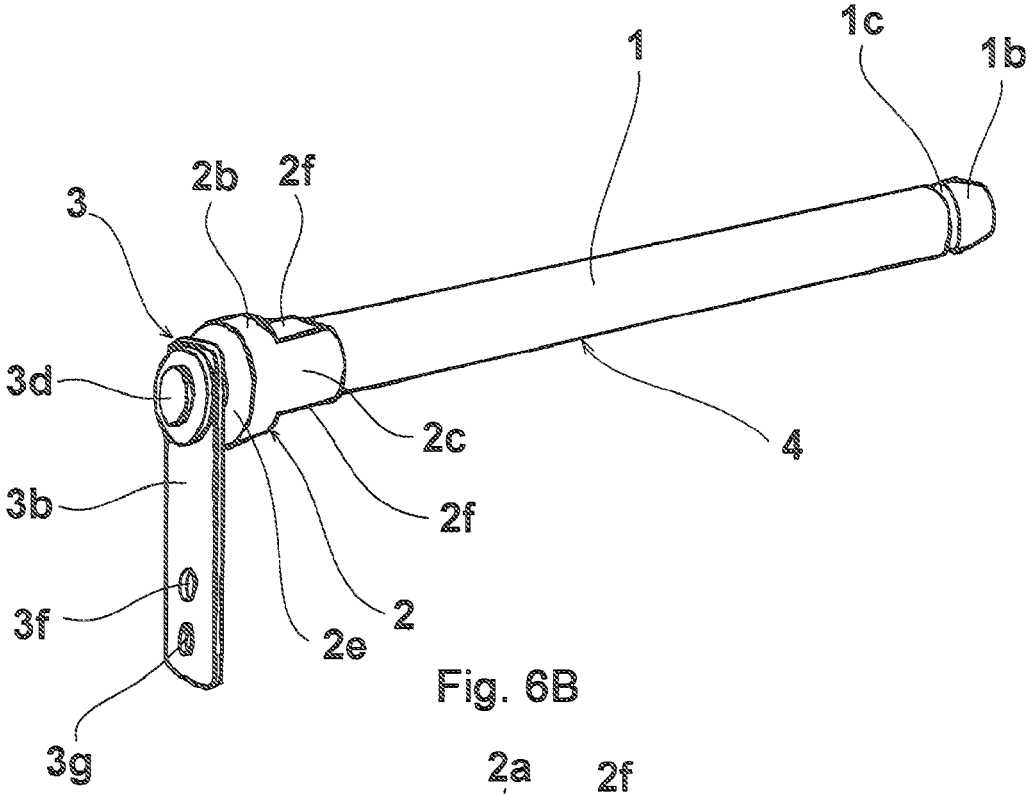
FIG. 6A shows a perspective view of a hinge-shaft assembly according to the present invention, in which a hinge shaft and a brake shaft and a braking device have been coupled in advance.
Figure 6B:
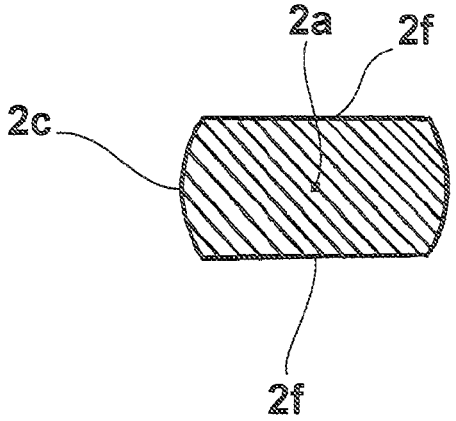
FIG. 6B shows a vertically sectional view of the locking part of the brake shaft, which is orthogonal to the rotational axis of the brake shaft.

The braking device 3 has the structure that a friction plate 3*a*, a brake plate 3*b*, a spring plate 3*c* and a washer 3*d* are rotatably mounted to a support shaft 2*d* and the end of the support shaft 2*d* is swaged to form a swaged portion 3*e*. The friction plate 3*a* and the brake plate 3*b* may be fabricated from the stainless steel of SUS304. The spring plate 3*c* and the washer 3*d* may be fabricated from SK steels (carbon tool steels). The friction plate 3*a*, the brake plate 3*b*, the spring plate 3*c* and the washer 3*d* of the braking device 3 are clamped between the end face 2*e* of the cylindrical column 2*b* and the swaged portion 3*e* of the support shaft 2*d*, so that the friction plate 3*a* is pressed against the end face 2*e* of the cylindrical column 2*b* and the brake plate 3*b* at a predetermined amount of pressure by the elastic force of the spring plate 3*e*. The spring plate 3*e* may be formed as a wavy plate having a series of curved portions and held tightly between the brake plate 3*b* and the washer 3*d* so that the spring plate 3*c* generates the elastic force in a direction parallel to the rotational axis 2*a*. The washer 3*d* lies between the swaged portion 3*e* and the spring plate 3*c* so as to apply the elastic force of the spring plate 3*c* to the friction plate 3*a* uniformly. In FIG. 6A, reference numerals 3*f*, 3*g* indicate through-holes formed in the lower part of the brake plate 3*b* and those through-holes 3*f*, 3*g* are used for securing the brake plate 3*b* to the lid 6 or the storage box 7.

Figure 2:
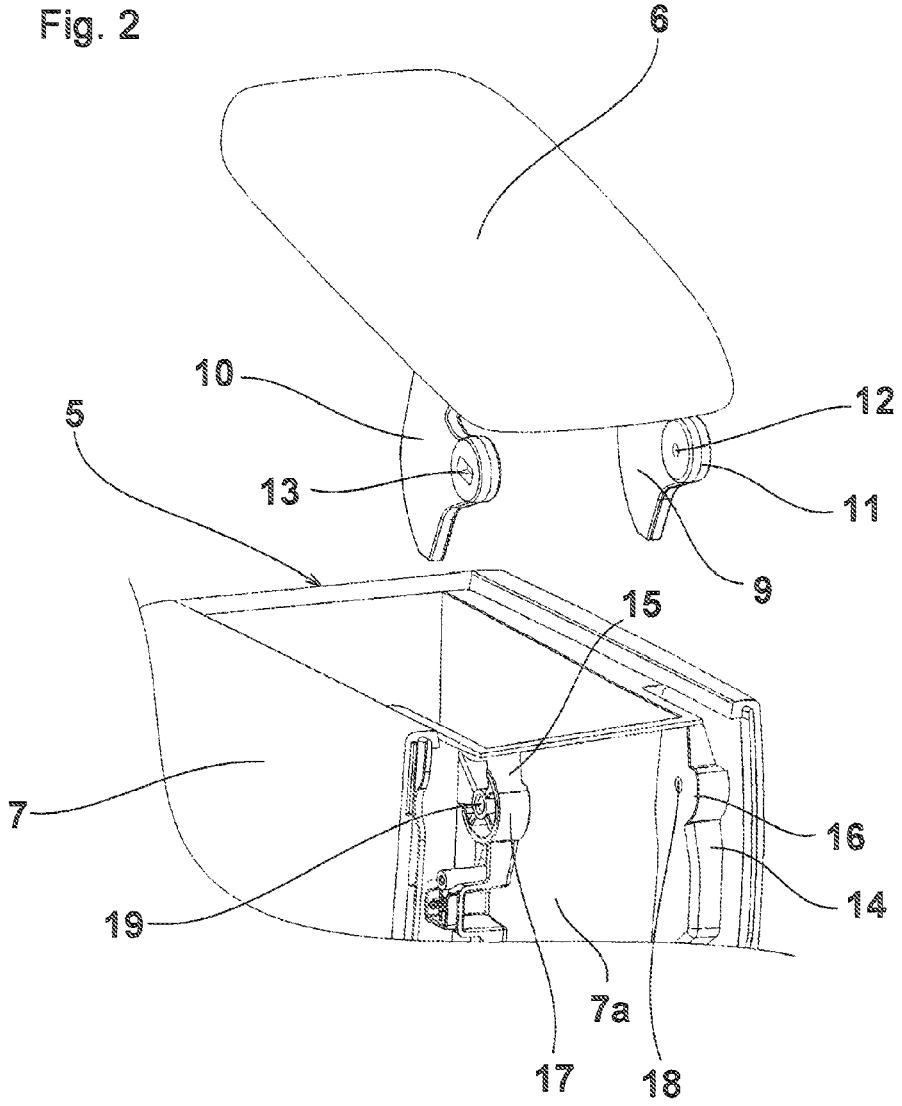
FIG. 2 shows a perspective rear view of the console box illustrated in FIG. 1, in which the lid is separated from the storage box.
Figure 3:
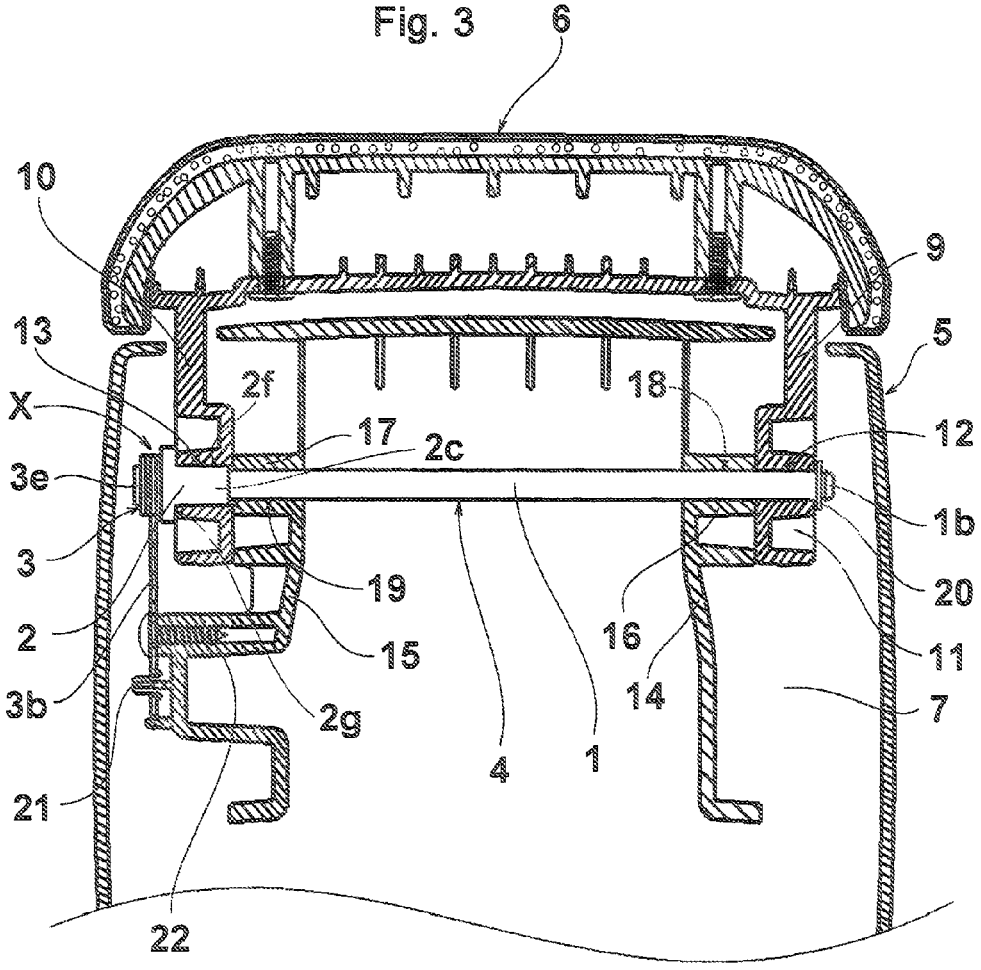
FIG. 3 shows a vertically sectional view of the connecting part of the console box illustrated in FIG. 1, wherein the lid is connected to the storage box by a hinge-shaft assembly, while a pair of bearing portions formed on the storage box are arranged between the connecting member and the bearing portion of the lid, and the brake plate of the hinge-shaft assembly is secured to the storage box.

As illustrated in FIGS. 1 to 3, the lid 6 has a bearing member 9 and a connecting member 10 and those members 9 and 10 extend from the undersurface of the lid 6 downwardly. The bearing member 9 is provided with a bearing portion 11 and the bearing portion 11 is provided with a through-hole 12 that is adapted to support the hinge shaft 1 rotatably. On the other hand, the connecting member 10 is provided with an engaging hole 13 that is adapted to receive the flattened portion 2*c* of the brake shaft 2, tightly. The flattened portion 2*c* of the brake shaft 2 is inserted into the engaging hole 13, so that the flat surfaces 2*f*, 2*f* engage the flat surfaces formed on the corresponding parts of the engaging hole 13 in order to prevent the brake shaft 2 and the connecting member 10 from relatively revolving around the rotational axis 2*a* of the brake shaft 2. The flat surfaces 2*f*, 2*f* formed on the brake shaft 2 cooperate with the flat surfaces formed on the engaging hole 13 to form a locking part that rotate the brake shaft 2 together with the lid 6 when opening and closing the lid 6.

On the other hand, a pair of bearing members 14, 15 are formed on the back surface 7*a* of the storage box 7 and the bearing members 14, 15 are integrated with the storage box 7. Those bearing members 14, 15 are provided with bearing portions 16, 17, respectively, and the bearing portions 16, 17 are provided with through-holes 18, 19 that are adapted to support the hinge shaft 1 rotatably. In order to connect the lid 6 and the storage box 7 by the hinge-shaft assembly 4, the connecting member 10 of the lid 6 is arranged on the outer side of the bearing portion 17 of the connecting member 10 and simultaneously, the engaging hole 13 of the connecting member 10 and the through-hole 19 of the bearing portion 17 are aligned, as illustrated in FIG. 3. Simultaneously, the bearing portion 11 of the lid 6 is arranged on the outer side of the bearing portion 16 of the storage box 7, and the through-hole 12 of the bearing portion 11 and the through-hole 18 of the bearing portion 16 are aligned. Next, the engaging surface 2*g*, 2*g* of the brake shaft 2 is brought into contact with the outer surface of the connecting member 10 by inserting the hinge shaft 1 of the hinge-shaft assembly 4 into the engaging hole 13 of the connecting member 10 and then into the through-holes 19, 18, 12 from left to right in FIG. 3. Then the annular groove 1*c* of the hinge shaft 1 is projected from the lateral surface of the bearing member 9 by pushing the hinge shaft 1 axially. After that, the E-shape snap ring 20 is attached to the annular groove is of the hinge shaft 1 and then, the connecting member 10 and the bearing members 9, 14, 15 are clamed between the engaging surfaces 2*g*, 2*g* and the E-shape snap ring 20. Thereby, the connecting member 10 is pressed against the bearing member 15 while the bearing member 9 is pressed against the bearing member 14. When the hinge shaft 1 and the brake shaft 2 are mounted in this way, the brake plate 3*b* is secured to the storage box 7 by making the through-hole of the brake plate 3*b* of the braking device 3 engage a positioning pin 21 of the storage box 7 and then inserting a tap 22 into the through-hole 3*f*. Thereby, the installation of the braking device 3 is also completed. Since the brake shaft 2 and the braking device 3 are displaced in the axial direction of the hinge shaft 1, the hinge structure of the present invention can be installed in a limited space for installation.

When opening and closing the lid 6 in this state of the hinge structure, the brake shaft 2 and the hinge shaft 1 rotate as the lid 6 turns, while the brake plate 3*b* is secured to the storage box 7. Therefore, the friction plate 3*a* arranged between the brake shaft 2 and the brake plate 3*b* can generate desired frictional force due to the structure that the friction plate 3*a* is pressed against a rotating end face 2*e* and a stationary brake plate 3*b*. The frictional force can provide the lid 6 with a moderate force of resistance to the rotation when opening and closing the lid 6. Due to the frictional force, the lid 6 can be held at any position where the lid 6 stops rotating within the rotatable range of the lid 6. In addition, the lid 6 can smoothly be opened and closed even if a bending force and/or a twisting force are applied on the lid 6 when opening or closing the lid 6, because the connecting member 10 and the bearing member 9 of the lid 6 are held tightly between the engaging surfaces 2*g*, 2*g* of the brake shaft 2 and the E shape snap ring 20 so that the connecting member 10 and the bearing member 9 of the lid 6 are pressed against the bearing members 15, 14 of the storage box 7. Even if the thickness of each of the connecting member 10 and the bearing members 9, 14, 15 increase in the axial direction of the hinge shaft 1 by forming reinforcing ribs or the like (not shown) on those members 10, 9, 14, 15, the installation space for the hinge structure according to the present invention does not increase.

Second Embodiment

Figure 7:
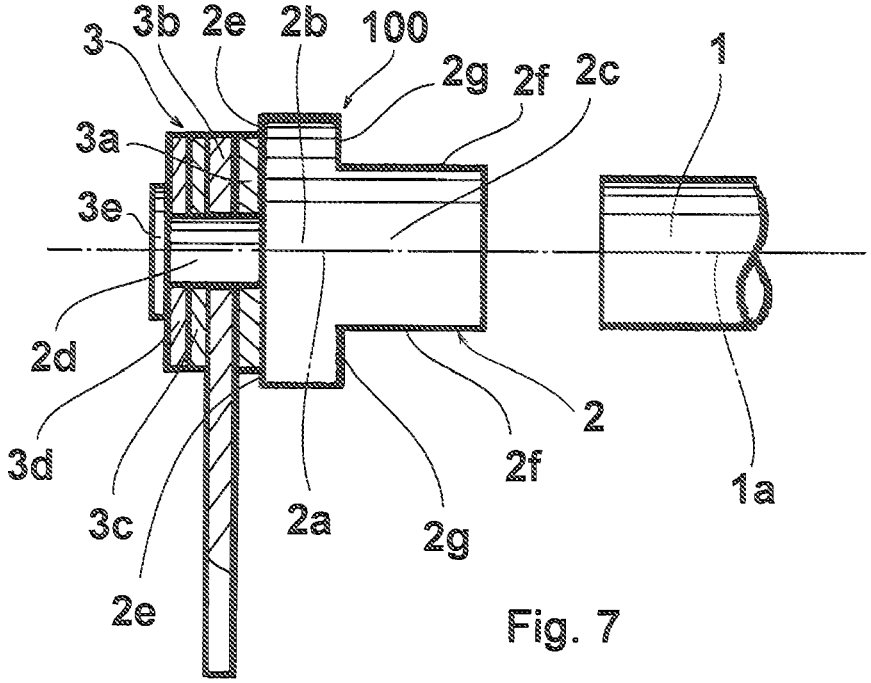
FIG. 7 shows a side view of a brake assembly according to the present invention, wherein the brake assembly is composed of a brake shaft and a braking device that are coupled preliminarily, but a hinge shaft is separated from the brake assembly.
Figure 8:
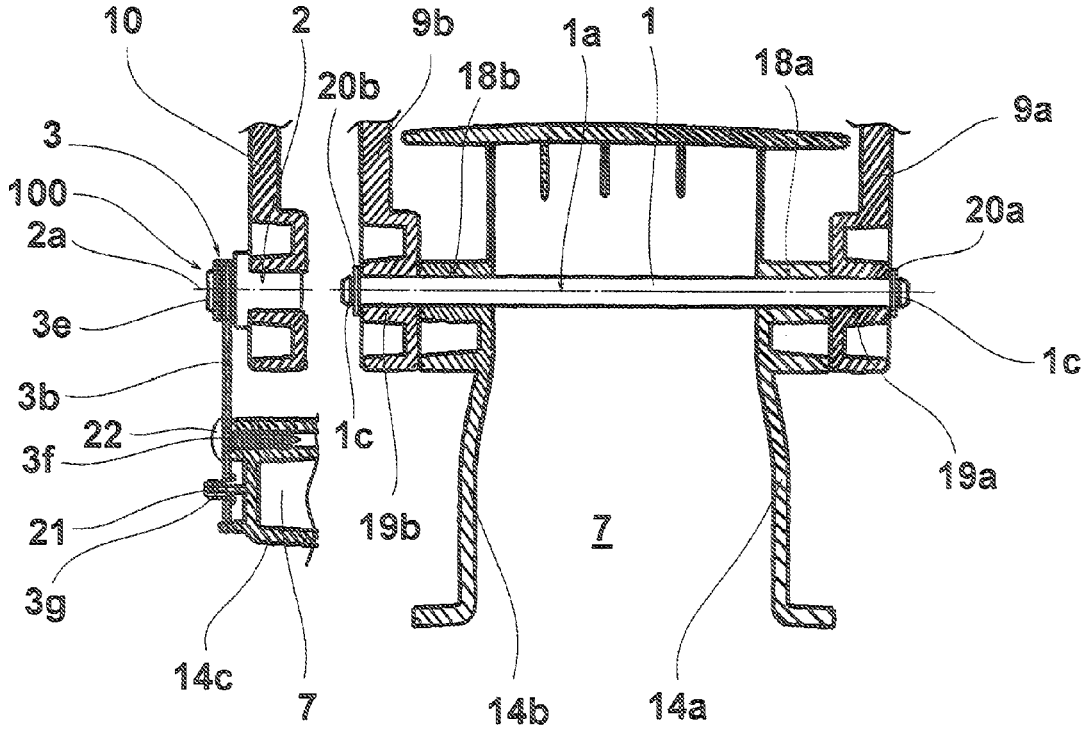
FIG. 8 shows a vertically sectional view of a connecting part of a storage box and a lid, wherein the lid-holding device and the hinge shaft illustrated in FIG. 7 are attached.

FIGS. 7 and 8 illustrate the second embodiment of the present invention. This embodiment is characterized by a structure that a hinge shaft 1 is separated from a brake shaft 2 of the lid-supporting structure 100, wherein the hinge shaft 1 is mounted between the lid 6 and the storage box 7 of the console box 5 for a vehicle and is adapted to rotatably connect the lid 5 to the storage box 7 as illustrated in FIGS. 1 to 3. The lid-supporting structure 100 is composed of a combination of the brake shaft 2 and the braking device 3 as illustrated in FIG. 7 in order to provide the console box 5 with an advantageous function of holding the lid 6 at any position where the lid 6 stops rotating around the brake shaft 2, although the brake shaft 2 is separated from the hinge shaft 1 in contrast to the first embodiment.

The brake shaft 2 of each of the first and second embodiments is the same configuration. The brake shaft 2 of the second embodiment comprises a cylindrical column 2*b*, a flattened portion 2*c* and a cylindrical support shaft 2*d*, wherein the central axis of each of the cylindrical column 2*b* and the flattened portion 2*c* and the cylindrical support shaft 2*d* coincides with the rotational axis 2*a*. The cylindrical column 2*b* has an end face 2*e* that extends in the direction perpendicular to the rotational axis 2*a*, so that the end face 2*e* defines a circular friction surface. The flattened portion 2*c* is located on one side of the cylindrical column 2*b* and integrated with the cylindrical column 2*b*. A pair of flat surface 2*f*, 2*f* are formed at the corresponding portions on the periphery of the flattened portion 2*c*. The flat surfaces 2*f*, 2*f* run parallel to the rotational axis 2*a* and form a locking part that prevents the brake shaft 2 from revolving around the rotational axis 2*a* of the brake shaft 2. Engaging surfaces 2*g*, 2*g* each are formed between the cylindrical column 2*b* and each of the flat surfaces 2*f*, 2*f*, wherein the engaging surfaces 2*g*, 2*g* extend in a direction perpendicular to the rotational axis 2*a*. The engaging surfaces 2*g*, 2*g* run parallel to the end face 2*e* of the cylindrical column 2*b* so as to define a retaining part for preventing disengagement of the brake shaft 2. A support shaft 2*d* protrudes from the center of the end face 2*e* of the cylindrical column 2*b* and runs in the direction parallel to the rotational axis 2*a*.

The braking device 3 comprises a friction plate 3*a*, a brake plate 3*b*, a spring plate 3*e* and a washer 3*d*, which are rotatably mounted to a support shaft 2*d* and retained by a swaged portion 3*e* formed at the end of the support shaft 2*d*. The friction plate 3*a* and the brake plate 3*b* may be fabricated from the stainless steel of SUS304. The spring plate 3*c* and the washer 3*d* may be fabricated from SK steels (carbon tool steels). The friction plate 3*a*, the brake plate 3*b*, the spring plate 3*c* and the washer 3*d* of the braking device 3 are held tightly between the end face 2*e* of the cylindrical column 2*b* and the swaged portion 3*e* of the support shaft 2*d*, so that the friction plate 3*a* is pressed against each of the end face 2*e* of the cylindrical column 2*b* and the brake plate 3*b* at a predetermined amount of pressure due to the elastic force of the spring plate 3*c*. The spring plate 3*c* can be composed of a wavy plate including a series of curved portions and held tightly between the brake plate 3*b* and the washer 3*d* to produce an elastic force in a direction parallel to the rotational axis 2*a*. The washer 3*d* lies between the swaged portion 3*e* and the spring plate 3*c* so as to apply the elastic force of the spring plate 3*c* to the friction plate 3*a* uniformly. As illustrated in FIG. 6A, the lower part of the brake plate 3*b* is provided with through-holes 3*f*, 3*g* for securing the brake plate 3*b* to the lid 6 or the storage box 7.

In the embodiment illustrated in FIG. 8, the brake plate 3*b* is secured to the storage box 7 by inserting a tap 22 and a positioning pin 21 into the through-holes 3*f*, 3*g*. On the other hand, the brake shaft 2 and the lid 6 are connected by fitting the flattened portion 2*c* in a connecting member 10. Thereby, the brake shaft 2 may be turned around the rotational axis 2*a* in conjunction with opening and closing of the lid 6.

As illustrated in FIG. 8, a pair of bearing members 9*a*, 9*a* of the lid 6 and a pair of bearing members 14*a*, 14*b* of the storage box 7 are connected by the hinge shaft 1 in order that the lid 6 can rotate around the central axis 1*a* of the hinge shaft 1. In FIG. 8, reference numerals 18*a*, 18*b*, 19*a*, 19*b* indicate through-holes, respectively. The both ends of the hinge shaft 1 are provided with annular grooves 1*c*, 1*c* to which E shape snap rings 20*a*, 20*b* may be attached.

The lid-supporting structure 100 should be attached to the lid 6 and the storage box 7 in such a manner that the rotational axis 2*a* of the brake shaft 2 is coaxial with and coincident with the central axis 1*a* of the hinge shaft 1. Since the lid-supporting structure 100 is assembled as a unit separated from the hinge shaft 1, the lid-supporting structure 100 can provide a console box 5 for a vehicle with an advantageous function of holding the lid 6 at any position where the lid 6 stops rotating around the brake shaft 2, independently of a hinge joint for connecting the lid 6 to the storage box 7, rotatably.

INDUSTRIAL APPLICABILITY

The hinge structure of a console box according to the present invention is useful in rotatably connecting and temporarily holding a lid with respect to a storage box of a console box for a vehicle but would be broadly applicable to a storage box with a lid that is adapted to rotate around a hinge shaft.

What is claimed is:

1. A hinge structure of a storage container comprising:

a storage box having an opening for putting goods in said storage box and taking goods out of said storage box;

a lid adapted to close at least a part of said opening;

a hinge shaft rotatably connecting said lid to said storage box so that said lid can open and close at least a part of said opening;

a brake shaft having a rotational axis that is coaxial with said hinge shaft, and said brake shaft being adapted to rotate about said rotational axis together with said lid;

a braking device comprising a brake plate to generate a stable friction force in cooperation with an end face of said brake shaft, so that said stable friction force provides said brake shaft with rotational resistance to retain said lid at any position where said lid stops rotating around said hinge shaft;

wherein said storage box and said lid each have a bearing member that comprises a bearing portion to support said hinge shaft rotatably, a side surface of said bearing member of said lid being arranged to abut on a side surface of said bearing member of said storage box so as to open and close said lid smoothly, said lid having a connecting member with which said brake shaft is engaged so that said lid and said brake shaft integrally rotate around said rotational axis when said lid rotates around said hinge shaft, said storage box having another bearing member, a side surface of said connecting member of said lid being arranged to abut on a side surface of said another bearing member so as to open and close said lid smoothly; and wherein said braking device is arranged beside said end face of said brake shaft, said brake plate extending in a direction intersecting said rotational axis, said brake plate being arranged along said end face of said brake shaft and secured with respect to said storage box, said braking device further comprising a friction plate disposed between said brake plate and said end face of said brake plate, a support shaft integrally formed on said end face of said brake shaft projecting along said rotational axis with said friction plate and said brake plate engaged with said support shaft, a swaged portion formed at the end of said support shaft with a spring plate and a washer pressed between said swaged portion and said brake plate so that said friction plate is pressed against said end face and said brake plate.

2. The hinge structure as recited in claim 1, wherein said end face of said brake shaft is formed at one end of said brake shaft and oriented so that said end face extends in the direction of intersecting with said rotational axis.

3. The hinge structure as recited in claim 1, wherein locking means for preventing said brake shaft and said connecting member from relatively revolving around said rotational axis are arranged between said brake shaft and said connecting member.

4. The hinge structure as recited in claim 1, wherein said braking device consists of said friction plate and said brake plate and said spring plate and said washer, which are arranged between said end face of said brake shaft and said swaged portion of said support shaft, and said braking device being located outside said end face of said brake shaft.

5. The hinge structure as recited in claim 1, wherein said end face is formed at one end of said brake shaft, said hinge shaft being integrally formed at the other end of said brake shaft, said support shaft is integrally formed on said end face of said brake shaft so that said support shaft projects along said rotational axis, said braking device having said brake plate being mounted to said support shaft, and thereby a hinge-shaft assembly being composed of an integrated combination of said hinge shaft and said brake shaft and said braking device.

6. The hinge structure as recited in claim 5, wherein said brake shaft and said braking device are displaced in the axial direction of said hinge shaft.

7. The hinge structure as recited in claim 1, wherein said support shaft is integrally formed on said end face of said brake shaft so that said support shaft projects along said rotational axis, said braking device having said brake plate being mounted to said support shaft, and thereby a brake assembly being composed of an integrated combination of said brake shaft and said braking device, so that said brake assembly is configured as an independent lid-holding device.

8. The hinge structure as recited in claim 7, wherein said brake assembly or said lid-holding device is displaced in the axial direction of said hinge shaft.

9. The hinge structure as recited in claim 5, wherein said hinge shaft and said brake shaft of said integrated combination have a portion extending between said bearing members of said storage box, and said hinge shaft and said brake shaft of said integrated combination having a portion extending between said bearing member and said connecting member of said lid.

10. The hinge structure as recited in claim 7, wherein said hinge shaft has a portion extending between said bearing members of said storage box.

* * * * *